US005811810A

United States Patent [19]

Hellemans et al.

[11] Patent Number: 5,811,810

[45] Date of Patent: Sep. 22, 1998

[54] INFRARED SENSOR AND METHOD FOR MAKING SAME

[75] Inventors: Roel Hellemans; Michel Pierbon, both of Tournefeuille, France

[73] Assignee: Siemens Automotive S.A., Toulouse Cedex, France

[21] Appl. No.: 765,541

[22] PCT Filed: Jun. 8, 1995

[86] PCT No.: PCT/EP95/02214

§ 371 Date: Dec. 30, 1996

§ 102(e) Date: Dec. 30, 1996

[87] PCT Pub. No.: WO96/00956

PCT Pub. Date: Jan. 11, 1996

[30] Foreign Application Priority Data

Jun. 29, 1994 [FR] France ..... 94 08135

[51] Int. Cl.[6] ..... G08C 23/04

[52] U.S. Cl. ..... 250/338.1; 250/DIG. 1

[58] Field of Search ..... 250/338.1, DIG. 1

[56] References Cited

U.S. PATENT DOCUMENTS 4,823,051 4/1989 Young ..... 315/155

FOREIGN PATENT DOCUMENTS 9208631.4 11/1992 Germany .

*Primary Examiner*—Michael J. Tokar
*Assistant Examiner*—Richard Hanig
*Attorney, Agent, or Firm*—Herbert L. Lerner; Laurence A. Greenberg

[57] ABSTRACT

The present invention relates to an infrared sensor (20) of the type comprising a support plate (22) provided with a printed circuit carrying a plurality of elements (23) sensitive to infrared waves and a dome (21) designed to cover said sensitive elements. This sensor is characterized in that: cutouts (27) are made in the support plate (22) around each sensitive element, each of these cutouts delimiting a tongue (28). These tongues are designed to be deployed outside the plane (P) of the support plate and to interact with the dome (21) in such a way that they adopt a defined position with respect to one another. The sensor according to the present invention is more particularly intended to equip automobile courtesy lights and to form part of an antitheft and/or centralized door-locking device.

9 Claims, 1 Drawing Sheet

Fig.1
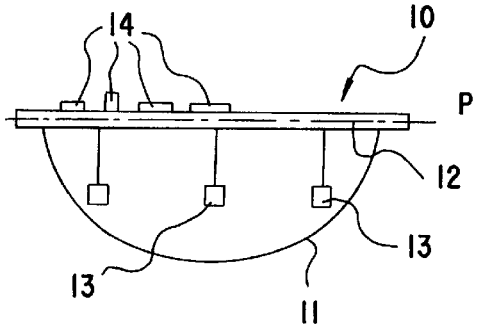
Fig.2
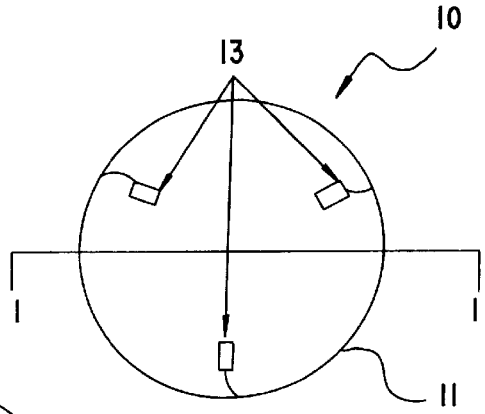
Fig.3
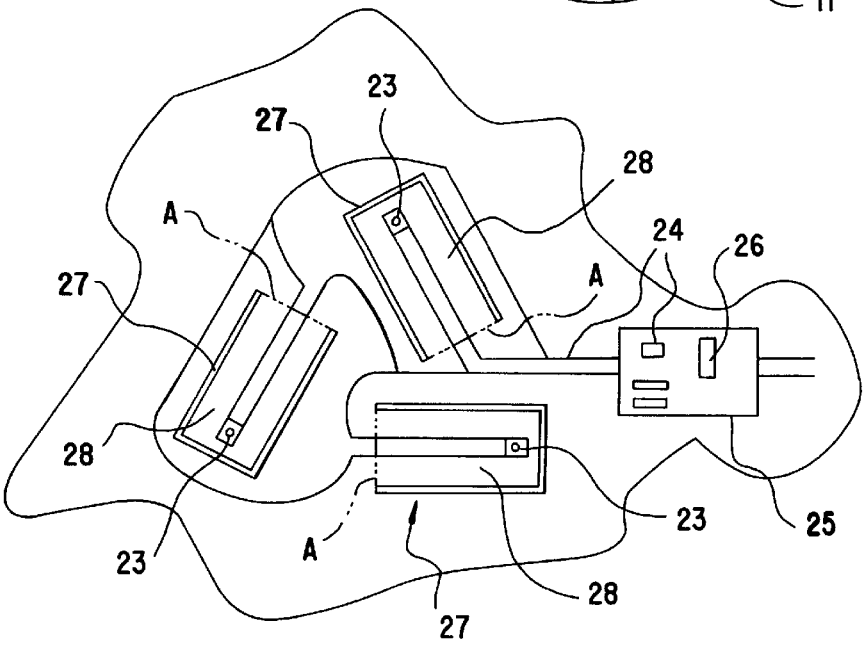
Fig.4
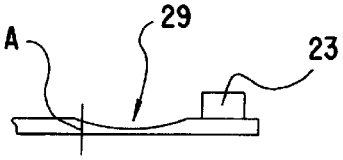
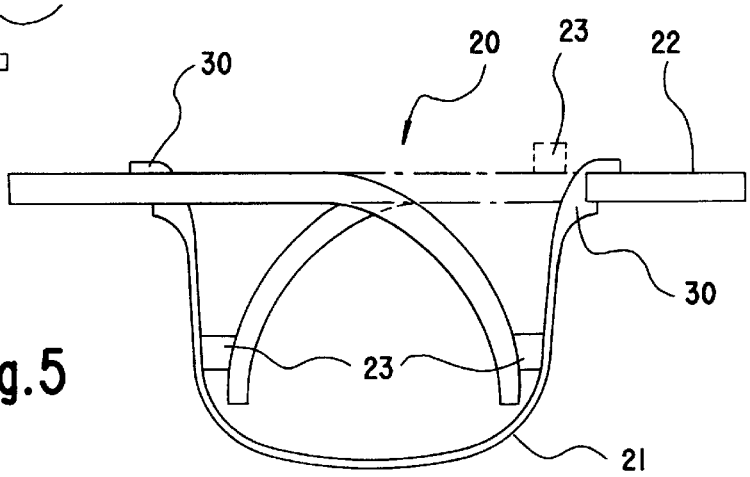
Fig.5

INFRARED SENSOR AND METHOD FOR MAKING SAME

BACKGROUND OF THE INVENTION

1. Field of the Invention

The present invention relates to an infrared sensor and a method of producing such a sensor. More particularly, it concerns a sensor installed in an automobile courtesy light and forming part of a centralized door-locking actuation device and/or an antitheft device.

2. Description of the Related Art.

It is already known to use infrared sensors to actuate the centralized door-locking system of a vehicle (and/or as an antitheft device). Currently, this type of sensor consists of three elements sensitive to infrared waves, arranged at 120°0 with respect to one another. A dome made of a material transparent to infrared radiation completely covers these elements. The fact that the elements are distributed so as to cover 360° makes it possible to pick up any infrared radiation directed towards the sensor, whatever the position of the device emitting radiation.

In order to produce such sensors, it is necessary to place the three sensitive elements so as to project from the plane of the courtesy light itself. This means that these sensitive elements are placed in a production step separate from that in which the other electronic components of the door-locking device are placed. However, it is not possible for the same automatic insertion machine to put into place electronic components lying not only in different planes but also on different faces. This is because the sensitive elements are generally placed on one face of the circuit while all the other components are placed on the other face. Consequently, although the infrared sensors known hitherto comprise a limited number of parts, their production is nevertheless lengthy and expensive.

SUMMARY OF THE INVENTION

The object of the present invention is to alleviate all these drawbacks and to produce an infrared sensor not requiring any special placing technique for the infrared-wave-sensitive elements. It is furthermore sought to decrease the manufacturing time and costs.

For this purpose, the present invention relates to an infrared sensor of the type comprising a support plate provided with a printed circuit carrying a plurality of elements sensitive to infrared waves and a dome designed to cover the sensitive elements. According to the invention, this sensor is characterized in that:

cutouts are made in the support plate around each sensitive element, each of these cutouts delimiting a tongue designed to be deployed outside the plane of the support plate and to interact with the dome in such a way that it adopts a defined position with respect to the other tongues.

By virtue of such arrangements, the sensitive elements are put in place on the support plate at the same time as the other electronic components and on the same face as the latter. This is because these sensitive elements are laid flat on the support plate. In a second step, the tongues carrying the sensitive elements are deployed and project from the plane of the support plate, beneath the latter.

According to the invention, the tongues for supporting the sensitive elements are produced by simply cutting the support plate. The predetermined positioning of the sensitive elements, with respect to one another, is advantageously achieved by orienting each cutout and by interaction of the dome with each of the sensitive elements.

Advantageously, it will be noted that the dome is fixed on the support plate by elastic fitting of fixing members forming part of the dome, in the cutouts which are produced in the support plate and are left free by the deployment of the tongues.

Also advantageously, in order to facilitate the deployment of the tongues, a thinned part is produced on the body of the latter in the region of their line of bending. The present invention extends to the method of manufacturing such sensors.

BRIEF DESCRIPTION OF THE DRAWINGS

Further objects, characteristics and advantages of the present invention will furthermore emerge from the description which follows, by way of nonlimiting example and with reference to the appended drawings in which:

FIG. 1 is a diagrammatic sectional view along the line I—I in FIG. 2 and shows a known infrared sensor;

FIG. 2 is a diagrammatic plan view of the sensor of known type shown in FIG. 1;

FIG. 3 is a diagrammatic plan view showing the sensor according to the present invention;

FIG. 4 is a diagrammatic view on a larger scale of a tongue according to the invention; and FIG. 5 is a diagrammatic elevation view of the sensor according to the present invention.

DESCRIPTION OF THE PREFERRED EMBODIMENT

An infrared sensor 10 of known type (FIGS. 1 and 2) takes the form of a dome 11 transparent to infrared waves, fitted into a support plate 12. Three elements 13 sensitive to infrared radiation are uniformly distributed on the internal periphery of this dome. In the example shown, these elements are placed at 120° with respect to one another.

As will be noticed in FIG. 1, these sensitive elements are not arranged in the plane P of the support plate but project from this plate. Moreover, the support plate 12 conventionally carries an electronic circuit for controlling the sensitive elements. This electronic control circuit is simply schematized by a plurality of electronic components 14 placed on the upper face of the plate 12. The result of this is that all the electronic components 14 and the sensitive elements 13 cannot be put in place at the same time since they are not arranged on the same face of the support plate 12.

According to the invention, the sensor 20 (FIG. 5) comprises a dome 21 fixed on a support plate 22. Three sensitive elements 23 are arranged at 120° with respect to one another in the plane of the support plate 22. Each of the sensitive elements is supplied via conducting wires 24 connected to a control unit 25. This control unit is arranged on the same face of the plate 12 as the sensitive elements and comprises a number of known electronic components 26. In a known manner, the control unit 25 consists of a printed circuit produced by direct printing of the material making up the support plate. This control unit supplies the various sensitive elements (23).

Cutouts 27 are produced around each sensitive element 23 and delimit tongues 28. Each of these tongues carries a sensitive element. The orientation of the cutout forming each tongue is predetermined in such a way that, after bending about its line of bending A, the tongue is at 120° to the two other tongues.

Furthermore, in order to facilitate the bending of each tongue, a thinned part 29 may be produced in the region of the line of bending A (FIG. 4).

The mounting of such a sensor is detailed herein-below.

The support plate 22, provided with the suitable cutouts 27 as well as with the sensitive elements 23 and electronic components 26 which are necessary, is subjected to a press which deforms the tongues 28 downward (FIG. 5). At the same time, the transparent dome 21 is put in place in the support plate by inserting fixing members 30 into the spaces left free by the deployment of the tongues 28.

The tongues are advantageously held in the deployed position by the interaction of the internal surface of the dome 30*a* with each sensitive element 23.

FIG. 5 shows in dot-dash lines the position of the tongue before bending and then in solid lines its position after bending. Also shown in this figure, in dotted lines, is the deployed position of a second tongue. In order not to overly complicate the drawing, the position of the third tongue has not been shown. The elastic fitting of the fixing members of the dome 30 on the support plate 20 will also be noticed in this figure.

Advantageously, it will be noted that the electronic components used are so-called surface mounted electronic components. Consequently, the printed circuit 25 does not need to be perforated in order to allow passage for leads of so-called through-components.

Advantageously, production of cutouts 27 according to the present invention makes it possible to produce a sensor all of whose electronic components are put in place flat, on the same face and therefore in a single step. The deployment of the tongues in a second step subsequently makes it possible to produce the required space and the required positioning between the various sensitive elements 23.

As a variant, the number of sensitive elements may be greater (or less) than three.

The present invention also relates to a method of producing such a sensor, characterized in that it comprises the following steps:

a) cutting a support plate (22) provided with a printed circuit so as to produce a plurality of tongues (28);

b) putting electronic components (26) and sensitive elements (23) in place on the same face of the support plate;

c) deploying the tongues (28); and d) fixing a dome (21) on the support plate, said dome interacting with the sensitive elements in order to keep them in a predetermined position and interacting with the cutouts (27) for its fixing (30) on the support plate. It will be noted that the order of steps a) and b) may be reversed.

So as to decrease the cost of producing such a sensor, it is possible to produce the printed circuit by hot deposition of a conductive pattern on the support plate.

Of course, the present invention is not limited to the embodiment described and shown. Thus, the shape and dimensions of the cutouts 27 may be other than those shown. Likewise, the dome 21 may be fixed to the support plate 22 by any appropriate means.

We claim:

1. An infrared sensor, comprising:

a support plate defining a given plane, a plurality of sensor elements being sensitive to infrared waves supported on said support plate, a printed circuit electrically connecting said plurality of sensor elements, and a dome covering said sensor elements;

said support plate having cutouts formed therein around each of said sensor elements, said cutouts each delimiting a tongue, and each of said tongues projecting out of the given plane of said support plate and interacting with said dome so as to assume a defined position relative to the respectively other tongues.

2. The sensor according to claim 1, which further comprises members for attaching said dome to said support plate, said members engaging in said cutouts.

3. The sensor according to claim 1, wherein each said tongue is provided with a relatively thinner portion for facilitating deployment thereof outside the given plane of said support plate.

4. The sensor according to claim 1, wherein said plurality of sensor elements are three sensor elements.

5. The sensor according to claim 1, wherein said printed circuit is directly printed with the material making up said support plate and supplying said sensor elements.

6. The sensor according to claim 1, wherein said support plate has a face surface, and said printed circuit and said sensor elements are disposed on said face surface.

7. A method of producing an infrared sensor of the type having a support plate defining a given plane, a printed circuit on said support plate and carrying a plurality of infrared sensor elements, and a dome covering the sensor elements, the method which comprises:

a) providing a support plate with a printed circuit and forming cutouts by cutting a plurality of tongues in the support plate;

b) placing electronic components and sensor elements on a face of the support plate;

c) deploying the tongues such that the tongues assume given positions relative to one another; and d) affixing a dome to the support plate by engaging the dome at cutouts formed in the support plate, and keeping the sensor elements in predetermined positions with the dome.

8. The method according to claim 7, wherein step b) is performed prior to step a).

9. The method according to claim 7, wherein step b) comprises placing surface mounted components on the support plate, and wherein the printed circuit is formed by hot deposition of a conductive pattern on the support plate.

* * * * *